United States Patent [19]

Morris, Sr.

[11] Patent Number: 4,832,596

[45] Date of Patent: May 23, 1989

[54] CHILD RESISTANT CIGARETTE LIGHTER

[76] Inventor: Glenn H. Morris, Sr., 1192 Cumberland Rd., Chattanooga, Tenn. 37419

[21] Appl. No.: 182,135

[22] Filed: Apr. 15, 1988

[51] Int. Cl.[4] ..... F23D 11/36

[52] U.S. Cl. ..... 431/153; 431/277; 222/153

[58] Field of Search ..... 251/95, 111, 113; 222/153, 402.11; 431/153, 254, 144, 267, 273, 274, 276, 277

[56] References Cited

U.S. PATENT DOCUMENTS

| | | | |
|---|---|---|---|
| 1,599,894 | 9/1926 | Jach | 251/113 |
| 3,622,052 | 11/1971 | Gach | 222/402.11 |
| 3,749,286 | 7/1973 | Douglas | 222/153 |
| 3,828,982 | 8/1974 | Steigerwald | 222/402.11 |
| 3,918,614 | 11/1975 | Steiman | 222/153 |
| 4,758,152 | 7/1988 | Kordecki | 431/153 |

*Primary Examiner*—Noah P. Kamen

*Attorney, Agent, or Firm*—Brady, O'Boyle & Gates

[57] ABSTRACT

A child resistant cigarette lighter having a permanently attached stop member slidably mounted on a conventional disposable butane light for releasably engaging the gas valve actuating lever. The construction and arrangement of the light is such that an adult can easily manipulate the stop member and gas valve actuating lever while igniting the lighter, while such manipulation is beyond the dexterity of a child, thereby rendering the lighter child resistant.

10 Claims, 3 Drawing Sheets

FIG.1
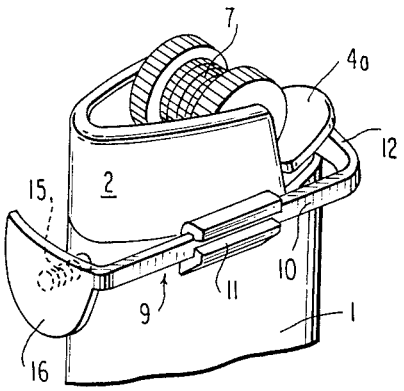
FIG.2
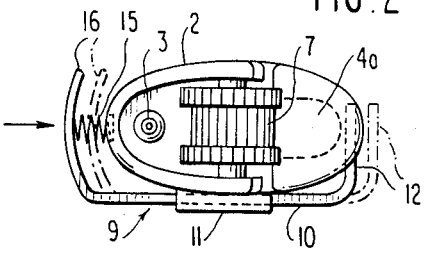
FIG.4
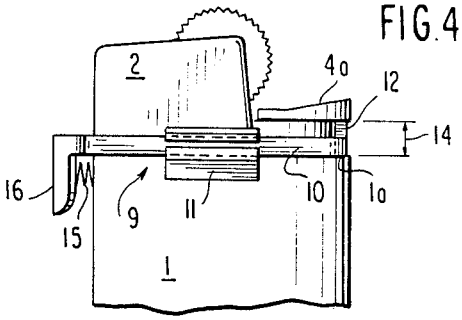
FIG.3
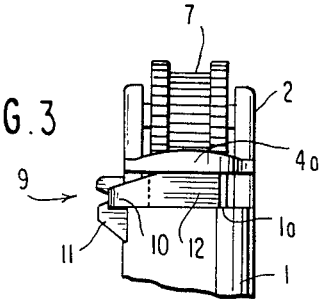
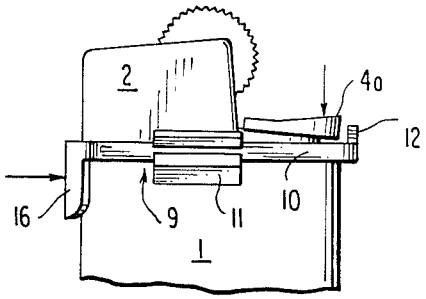
FIG.5
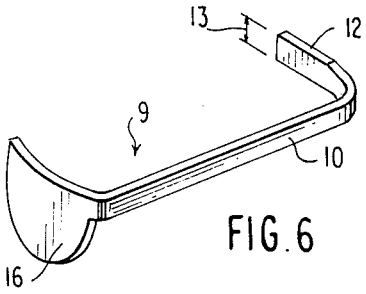
FIG.6
FIG.7
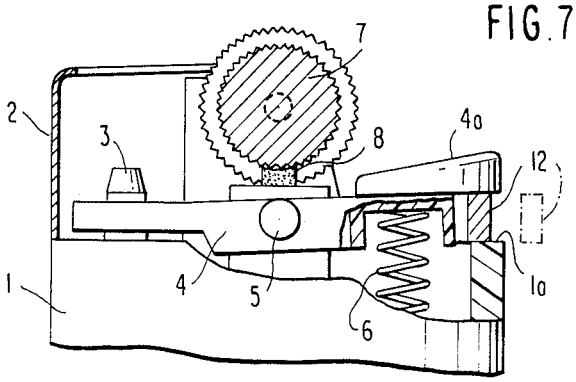

FIG. 14
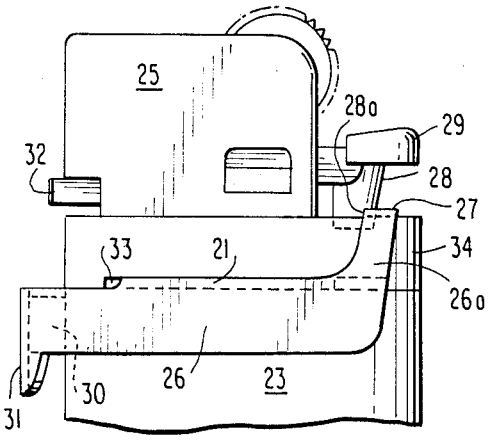
FIG. 15
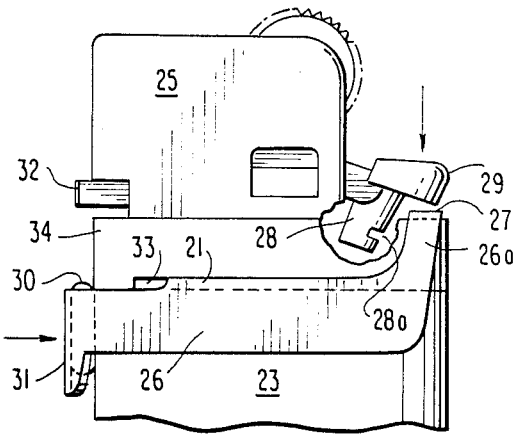
FIG. 16
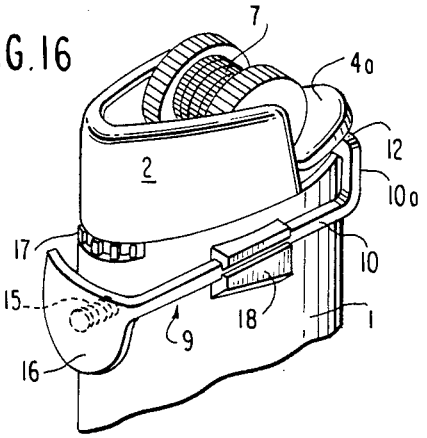
FIG. 17
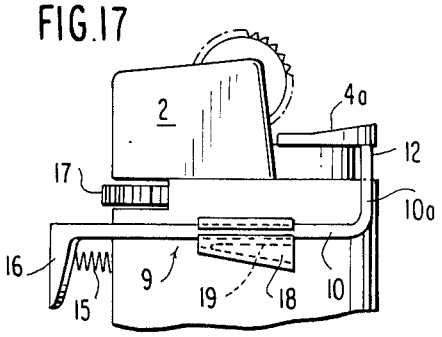
FIG. 18
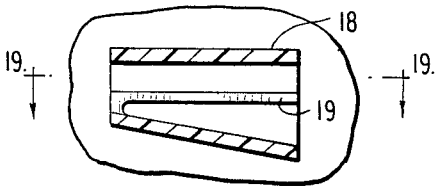
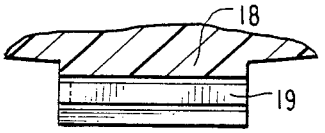
FIG. 19
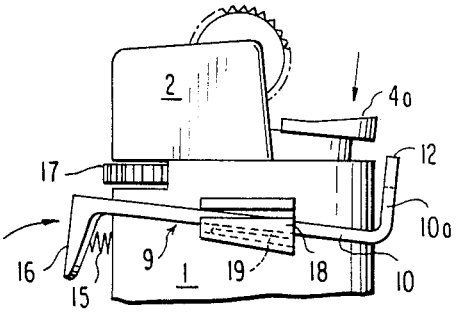
FIG. 20

CHILD RESISTANT CIGARETTE LIGHTER

BACKGROUND OF THE INVENTION

It has been reported that the Consumer Product Safety Commission announced that in 1985 children playing with cigarette lighters were blamed for 7800 fires resulting in 120 deaths, 860 injuries and $60.5 million in property damage, and that 96 per cent of lighters involved in accidents or fires were disposable butane models.

Applicant, in his continuous quest to invent child resistant products, such as medicine bottle caps and closures for pails or drums containing hazardous material, has now devised a child resistant cigarette lighter in response to the above-noted Consumer Product Safety Commission report.

Portable, disposable butane lighters have been provided with security devices to provide presale tamper protection, whereby the purchaser of the lighter is assured that the lighter has not been previously used. Such lighters are disclosed in U.S. Pat. Nos. 3,938,943 dated Feb. 17, 1976; 4,028,043 dated June 7, 1977; and 4,049,370 dated Sept. 20, 1977. In these lighters, the security devices are permanently removed from the lighters prior to the first use so that the lighter is freely actuated in subsequent uses. In other words, the security device is not replaced on the lighter once it has been removed.

After considerable research and experimentation, the child resistant cigarette lighter of the present invention has been devised which includes a slidable stop member mounted on a butane lighter and adapted to releasably engage the gas valve actuating lever. The construction and arrangement of the lighter of the present invention is such that an adult can easily manipulate the stop member and gas valve actuating lever while igniting the lighter, while such manipulation would be beyond the dexterity of a child, thereby rendering the lighter child resistant.

The child resistant lighter of the present invention comprises, essentially, a spring biased stop member slidably mounted on the top portion of a conventional portable, disposable butane cigarette lighter. The stop member is biased in a direction to place an end portion thereof underneath the lighter's gas valve actuating lever, to thereby prevent movement of the lever in a direction to open the gas valve. To actuate the lever, it is first necessary to push the stop member in a direction opposite to the biasing force of the spring, to thereby slide the end portion outwardly from underneath the lever.

BRIEF DESCRIPTION OF THE DRAWINGS

FIG. 1 is a perspective view of one embodiment of the child resistant cigarette lighter of the present invention;

FIG. 2 is a top plan view of the lighter shown in FIG. 1 showing, in phantom, the stop member in the lever release position:

FIG. 3 is an end elevational view of the lighter shown in FIG. 1, showing the stop member in the operative position underneath the gas valve actuating lever;

FIG. 4 is a side elevational view of the lighter shown in FIG. 1;

FIG. 5 is a side elevational view of the lighter showing the stop member moved to a position to release the gas valve actuating lever;

FIG. 6 is a perspective view of the stop member employed in the lighter embodiment shown in FIG. 1:

FIG. 7 is a fragmentary sectional view of the lighter showing the details of the valve actuating lever and a cooperating portion of the stop member;

FIG. 14 is a side elevational view of still another embodiment of the child resistant lighter;

FIG. 15 is a side elevational view of the lighter shown in FIG. 14 illustrating the stop member moved to the lever release position;

FIG. 16 is a perspective view of yet still another embodiment of the child resistant lighter;

FIG. 17 is a side elevational view of the lighter shown in FIG. 16;

FIG. 18 is a sectional side elevational view of the guide member in which the stop member is slidably mounted;

FIG. 19 is a view taken along line 19—19 of FIG. 18; and

FIG. 20 is a side elevational view of the lighter shown in FIG. 16 illustrating the stop member being moved to the lever release position.

DESCRIPTIONS OF THE PREFERRED EMBODIMENTS

Figure 8:
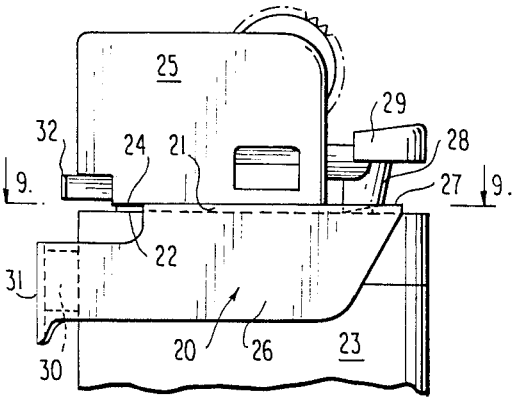
FIG. 8 is a side elevational view of another embodiment of the child resistant cigarette lighter.

Referring to the drawings and more particularly to FIGS. 1 and 7, one embodiment of the child resistant cigarette lighter of the present invention is shown which comprises a body portion 1 providing a reservoir for the lighter fuel, such as butane, a wind shield member 2 surrounding a burner valve 3, a valve actuating lever 4, having a thumb receiving portion 4*a*, pivotally connected as at 5 to the upper end portion of the lighter body and biased to the valve closed position by a spring 6. A flint wheel 7 and associated flint 8 are also mounted on the upper end portion of the lighter body.

The lighter, thus far described, is a conventional, disposable butane lighter, wherein the lighter is ignited by pressing down on the thumb receiving portion 4*a* of the lever to lift the burner valve 3 to the open position, to thereby allow the butane gas to escape from the reservoir and become ignited by the spark from the flint wheel assembly 7, 8 which is actuated simultaneously with the lever 4.

In order to render the lighter child resistant, a stop member 9 is provided which includes an arm portion 10 slidably mounted in a guide member 11 fixedly attached, as by molding, to one side of the lighter body portion 1 adjacent the wind shield 2. One end of the arm portion 10 has an inturned wedge portion 12, being dimensioned as at 13, FIG. 6, to be positioned between the space 14, FIG. 4, between the lower surface of the thumb receiving portion 4*a* of the lever and the top surface 1*a* of the body portion, to thereby prevent actuation of the lever 4. The stop member 9 is biased to the lever lock position by a spring 15 mounted between the lighter body portion 1 and an inwardly turned finger portion 16 on the opposite end of the arm portion 10.

In using the lighter shown in FIGS. 1 to 7, the user grasps the lighter in such a manner that the index finger engages the finger portion 16 of the stop member and pushes the arm 10 in the direction of the arrow, as shown in FIG. 2, to thereby slide the wedge portion 12 outwardly from underneath the thumb portion 4*a* of the lever 4. Simultaneously with the sliding of the stop member 9 to the released position, the user's thumb is employed for actuating the flint wheel assembly and the valve actuating lever 4 to ignite the lighter, as shown in FIG. 5. When released to extinguish the lighter, the spring 6 biases the thumb portion 4a upwardly to close the burner valve 3 and the spring 15 biases the arm 10 in the opposite direction to once again position the wedge portion thereof underneath the thumb portion 4a of the valve actuating lever 4.

Referring to FIGS. 16 to 20, the stop member 9 is shown mounted on a lighter of the type shown in FIG. 1 but including a gas flame adjustment wheel 17. In this embodiment, the guide member 18 is mounted on the side of the lighter body portion 1 somewhat below the wind shield 2 so that the finger portion 16 is below the flame adjustment wheel 17. The arm 10 is also provided with an upturned portion 10*a* in order that the inturned wedge portion 12 may be positioned underneath the lever thumb portion 4*a*.

As will be seen in FIGS. 18 and 19, the interior of the guide member 18 is provided with a spring finger 19 which supports the arm portion 10 of the stop member 9. The spring finger 19 not only allows the stop member 9 to slide in a direction to remove the wedge portion 12 from underneath the thumb engaging portion 4*a* of the gas lever, but also allows the arm 10 to be tilted downwardly, whereby the wedge portion 12 is moved to a position, as shown in FIG. 20, so as not to interfere with the user's thumb when pressing down on the thumb portion 4*a* of the gas valve actuating lever.

When the stop member 9 is released, the spring finger 19 returns the arm 10 to the horizontal position while the spring 15 simultaneously moves the finger portion 16 outwardly, to thereby portion the wedge member 12 underneath the thumb portion 4*a*, as shown in FIG. 17.

Figure 10:
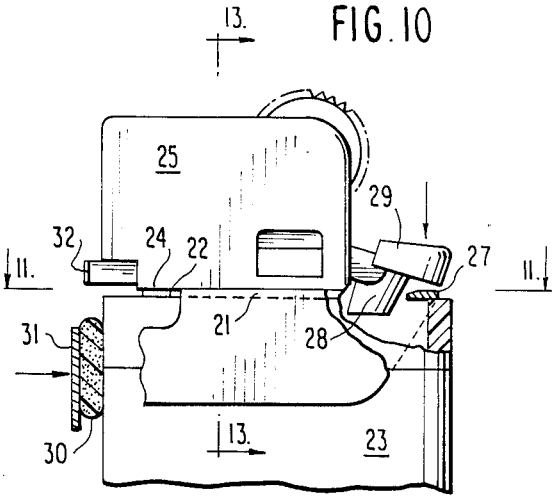
FIG. 10 is a fragmentary, sectional, side elevational view of the lighter shown in FIG. 8 illustrating the stop member moved to the lever release position.
Figure 9:
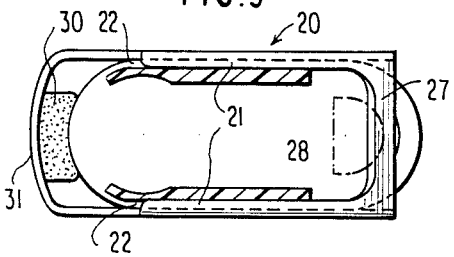
FIG. 9 is a view taken along line 9—9 of FIG. 8.
Figure 11:
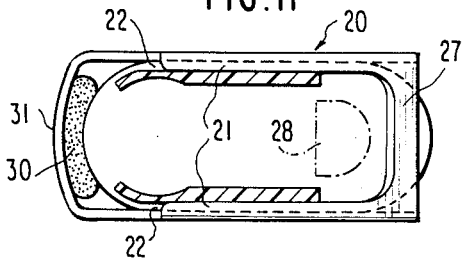
FIG. 11 is a view taken along line 11—11 of FIG. 10.
Figure 12:
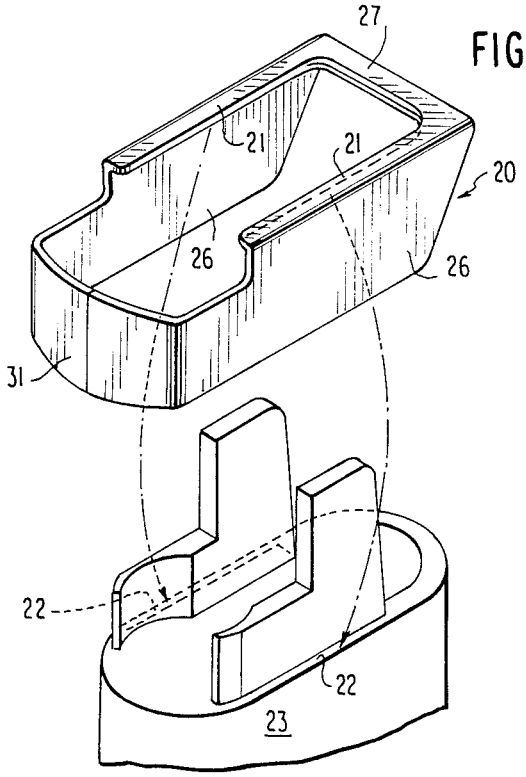
FIG. 12 is an exploded view of the stop member and top portion of the lighter shown in the embodiment of FIGS. 8 to 11.
Figure 13:
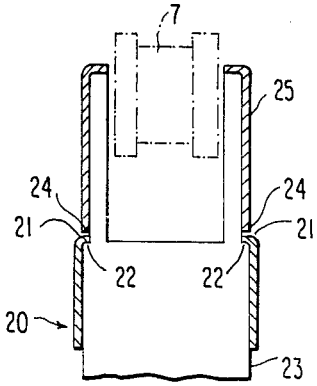
FIG. 13 is a view taken along line 13—13 of FIG. 10.

While the embodiments of the child resistant cigarette lighters shown in FIGS. 1 to 7 and 16 to 20 employ a stop member 9 having one arm portion 10 slidably mounted on one side of a lighter, FIGS. 8 to 15 disclose other embodiments of the invention wherein the stop member includes a pair of arm portions slidably mounted on each side of the lighter.

As will be seen in the embodiment illustrated in FIGS. 8, 9, 12 and 13, the stop member 20 comprises a pair of inwardly turned flanges 21 adapted to be slidably mounted on corresponding shoulders 22 provided on the upper end portion of the lighter body portion 23 below the lower edge 24 of the wind shield 25. Skirt portions 26 depend from the flanges 21 and are positioned on each side of the lighter body portion 23. The ends of the skirt portions are interconnected by a transversely extending wedge member 27 adapted to be positioned underneath the stem 28 of the thumb receiving portion 29 of the gas valve actuating lever, the wedge member 27 being biased to this position by a resilient pad 30 mounted between the lighter body and a transversely extending arcuate finger portion 31 integrally connected to the opposite end of the skirt portions 26. By the construction and arrangement of the depending skirt portions 26, the finger portion 31 is offset to a position well below the gas flame adjustment wheel 32, whereby there will be no interference when moving the stop member 20 in a direction to the lever release position while igniting the lighter as shown by the arrows in FIG. 10.

The embodiment shown in FIGS. 14 and 15 is similar to that of FIGS. 8 to 13; however, the inwardly turned flanges 21 are guidably mounted in slots 33 provided in the upper end portion 34 of the lighter body portion 23 and the skirts 26 are provided with upwardly turned portions 26*a* so that the wedge member 27 can be received in a slot 28*a* provided in the stem 28 of the thumb receiving portion 29.

From the above description, it will be readily apparent that various makes or models of conventional cigarette lighters can be rendered child resistant by providing the lighter with a permanently attached, slidably mounted stop member which prevents ignition of the lighter by a child but easily manipulatable by an adult to the release position while igniting the lighter.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A child resistant cigarette lighter comprising, a body portion providing a reservoir for the lighter fuel, an end portion provided on said body portion, a burner valve communicating with a fuel reservoir mounted on said end portion, a valve actuating lever having a thumb receiving portion pivotally mounted on and extending transversely of said end portion, a flint wheel and associated flint mounted on said end portion between said burner valve and thumb receiving portion, a permanently attached stop member extending substantially parallel with said valve actuating lever and slidably mounted on the lighter body portion in proximity to said end portion, said stop member having a finger engageable portion at one end spaced outwardly of the burner valve and lighter body portion for slidably moving said stop member parallel to said valve actuating lever, and having another portion releasably operatively connected to said valve actuating lever, whereby the stop member can be moved parallel to said lever from a lever immobilizing position to a lever release position by said finger engageable portion.

2. A child resistant cigarette lighter according to claim 1, wherein said another portion of the stop member is an end portion engageable underneath the thumb receiving portion of the valve actuating lever, and spring means mounted between the lighter body portion and said finger engageable portion of the stop member to bias the end portion of the stop member to a position underneath said thumb receiving portion, to thereby prevent movement of the lever in a direction to open the gas valve, said stop member being movable by said finger engageable portion in a direction opposite to the biasing force of the spring means, whereby the end portion is moved from underneath the thumb receiving portion, to thereby allow movement of the lever in a direction to open the gas valve.

3. A child resistant cigarette lighter according to claim 2, in which said end portion of said stop member has a bevel edge portion engageable underneath the thumb receiving portion of the valve actuating lever.

4. A child resistant cigarette lighter according to claim 1, wherein the thumb receiving portion includes a slot thereunder, said another portion of said stop member being and end portion engageable in the slot of the thumb receiving portion, spring means mounted between the lighter body portion and said finger engageable portion of the stop member biasing said end portion of the stop member into engagement in the slot to thereby prevent movement of the lever in a direction to open the gas valve, and said stop member movable by said finger engageable portion in a direction opposite to the biasing force of the spring means to move the end portion out of the slot to allow movement of the lever in a direction to open the gas valve.

5. A child resistant cigarette lighter according to claim 4, in which said end portion of said stop member includes a bevel edge portion engageable in the slot.

6. A child resistant cigarette lighter comprising, a body portion providing a reservoir for the lighter fuel, an end portion provided on said body portion, a burner valve communicating with a fuel reservoir mounted on said end portion, a valve actuating lever having a thumb receiving portion pivotally mounted on said end portion, a flint wheel and associated flint mounted on said end portion, a wind shield mounted on said end portion in proximity to said burner valve, a stop member slidably mounted on the lighter body portion in proximity to said end portion and releasably operatively connected to said valve actuating lever, said stop member having a guide member on a side of the lighter body portion, an arm portion slidably mounted in said guide member, an inturned wedge portion collected to one and of said arm portion, said wedge portion adapted to extend underneath the thumb receiving portion of said valve actuating lever, an inwardly turned finger portion on the opposite end of said arm portion, and spring means positioned between the lighter body portion and said finger portion to bias said edge portion of the stop member to a position underneath said thumb receiving portion, to thereby prevent movement of the lever in a direction to open the gas valve, and said stop member being movable in a direction opposite to the biasing force of the spring means from a lever immobilizing position to a lever release position, whereby the wedge portion is moved from underneath the thumb receiving portion, to thereby allow movement of the lever in a direction to open the gas valve.

7. A child resistant cigarette lighter according to claim 6, wherein additional means are mounted within said guide meter, said arm portion being slidably mounted on said additional spring means, whereby the stop member is not only slidable in a direction to remove the wedge portion from underneath the thumb receiving portion but also tiltable in a direction so as not to interfere wit the user's thumb when pressing down on the thumb receiving potion of the valve actuating lever.

8. A child resistant cigarette lighter comprising, a body portion providing a reservoir for the lighter fuel, an end portion provided on said body portion, a burner valve communicating with a fuel reservoir mounted on said end portion, a valve actuating lever having a thumb receiving portion pivotally mounted on said end portion, a flint wheel and associated flint mounted on said end portion, a wind shield mounted on said end portion in proximity to said burner valve, a stop member slidably mounted on the lighter body portion in proximity to said end portion and releasably operatively connected to said valve actuating lever, said stop member having a pair of inwardly turned flanges adapted to be slidably mounted on each side of the lighter body portion, a skirt portion depending from each flange, an end portion extending transversely between said skirt portions on one end thereof and engageable underneath the thumb receiving portion, a finger portion extending transversely between said skirt portions on the opposite end thereof, and spring means mounted between the lighter body portion and said finger portion to bias the end portion of the stop member to a position underneath said thumb receiving portion, to thereby prevent movement of the lever in a direction to open the gas valve, and said stop member being movable in a direction opposite to the biasing force of the spring means from a lever immobilizing position to a lever release position, whereby the end portion of said stop member is moved from underneath the thumb receiving portion to thereby allow movement of the lever in a direction to open the gas valve.

9. A child resistant cigarette lighter according to claim 8, wherein shoulders are provided on the end portion of said lighter, said flanges being slidably mounted on said shoulders.

10. A child resistant cigarette lighter according to claim 8, wherein slots are provided in the sides of the end portion of the lighter, said flanges being slidably mounted in said slots.

* * * * *